US005088251A

United States Patent [19]

Hazeldine

[11] Patent Number: 5,088,251

[45] Date of Patent: Feb. 18, 1992

[54] ACCESS FLOORING

[75] Inventor: Albert Hazeldine, Stanford Bridge, England

[73] Assignee: Tate Access Floors Limited, Shropshire, England

[21] Appl. No.: 497,987

[22] Filed: Mar. 23, 1990

[51] Int. Cl.[5] ..... E04B 1/18

[52] U.S. Cl. ..... 52/263

[58] Field of Search ..... 52/263, 126.6

[56] References Cited

U.S. PATENT DOCUMENTS

| | | | |
|---|---|---|---|
| 4,438,610 | 3/1984 | Fifer . | |
| 4,447,998 | 5/1984 | Griffin | 52/263 |
| 4,546,580 | 10/1985 | Ueno et al. . | |
| 4,578,910 | 4/1986 | Germeroth et al. | 52/263 |
| 4,621,468 | 11/1986 | Likozar | 52/263 |
| 4,922,670 | 5/1990 | Naka et al. | 52/263 |

FOREIGN PATENT DOCUMENTS

| | | |
|---|---|---|
| 0145247 | 6/1985 | European Pat. Off. . |
| 3818895 | 12/1988 | Fed. Rep. of Germany . |
| 1242674 | 10/1968 | United Kingdom . |
| 1473143 | 5/1977 | United Kingdom . |

*Primary Examiner*—David A. Scherbel
*Assistant Examiner*—Robert Canfield
*Attorney, Agent, or Firm*—Oblon, Spivak, McClelland, Maier & Neustadt

[57] ABSTRACT

Access flooring of the kind which includes floor panels carried in spaced relationship above a floor substrate by a support mechanism, having a single fastening member which acts to clamp adjacent parts of a plurality of the floor panels to a single element of said support mechanism.

3 Claims, 2 Drawing Sheets

ACCESS FLOORING

BACKGROUND OF THE INVENTION

1. Field of the Invention

This invention concerns access flooring of the kind (hereinafter termed of the kind referred to) comprising abutting floor panels carried in spaced relationship above a floor substrate by support means.

2. Discussion of the Background

Selected panels may be lifted to enable installation or rearrangement of underfloor cabling providing power, data transmission and communication facilities at desired locations above the floors.

SUMMARY OF THE INVENTION

The invention provides a novel support means giving a more integrated structure than hitherto.

According to the present invention there is provided access flooring of the kind referred to wherein a single fastening means acts to clamp adjacent parts of a plurality of said floor panels to a single element of said support means.

Each element of said support means may be a pedestal extending upwardly from the substrate.

Each pedestal may engage with the underside of the juxtaposed edges or corners of adjacent panels.

The edges or corners of the panels may be formed to provide collectively an apertured concave cup overlying each pedestal.

The fastening means may be comprised by a screw which threadedly engages the pedestal and whose head located in the concave cup.

BRIEF DESCRIPTION OF THE DRAWINGS

The invention will be further apparent from the following description with reference to the several figures of the accompanying drawings, which show, by way of example only, one form of access flooring embodying same.

Of the drawings.

DESCRIPTION OF THE PREFERRED EMBODIMENTS

Figure 1:
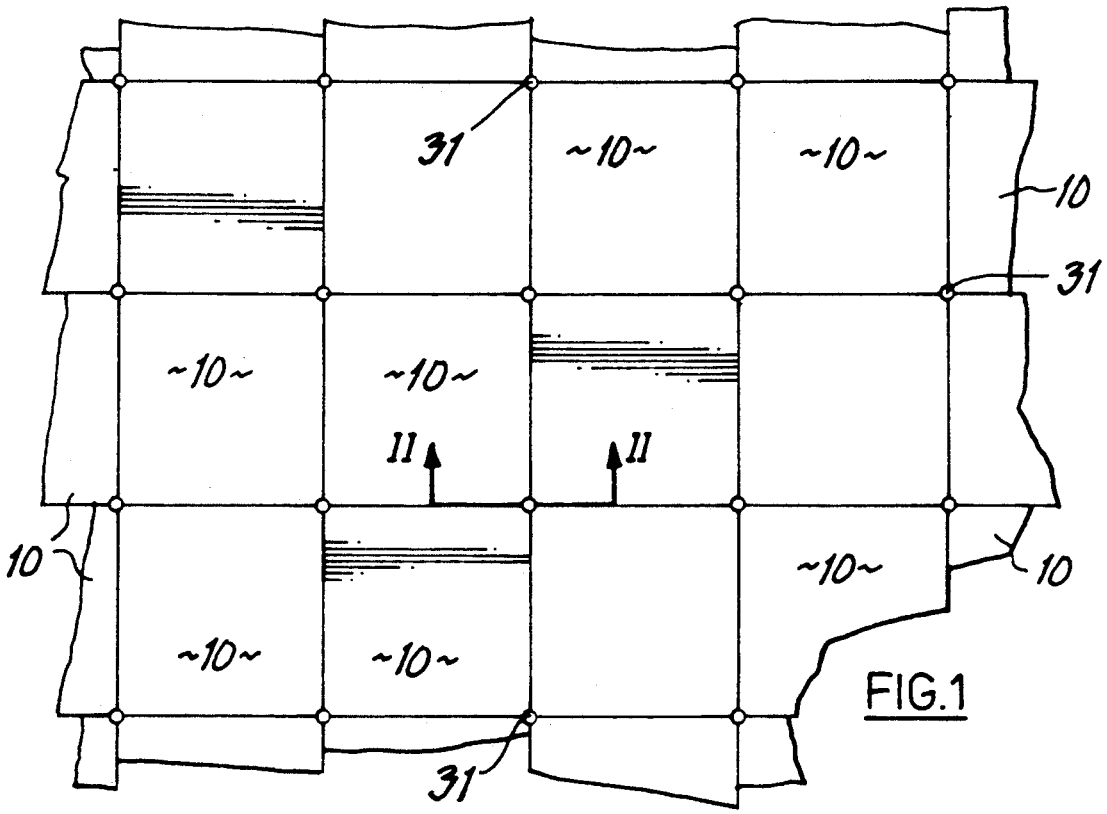
FIG. 1 shows a plan view of a part of the flooring.

Referring firstly to FIG. 1 it will be seen that the flooring is comprised by a plurality of rectangular or square panels 10 arranged in the fashion of a chequer-board with cruciform joints therebetween.

Figure 2:
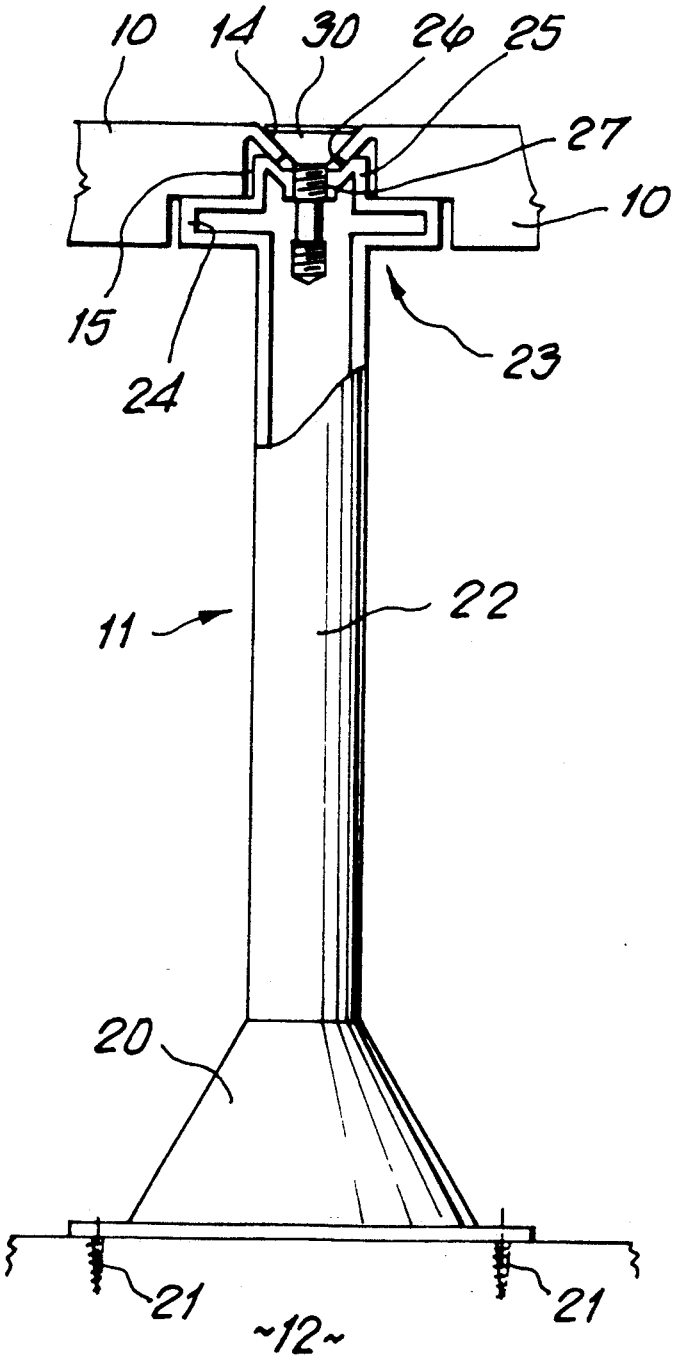
FIG. 2 shows on an enlarged scale a cross-section through the flooring on the line II—II of FIG. 1.

The panels 10 are supported by pedestals 11 (see FIG. 2) extending upwardly from a substrate 12, there being one pedestal 11 beneath the four adjacent corners at each cruciform joint.

Each pedestal 11 comprises a base 20 secured to the substrate 12 by screws 21 or other suitable means and supporting an upwardly extending tube 22 mounting a head 23 which provides an annular flange 24 around a boss 25 having a cup formation 26 on its upper surface. A threaded bore 27 is provided at the base of the cup 26.

Each corner of each panel 10 is defined by a quarter annular concave lip formation, such that the four juxtaposed corners of four adjacent panels 10 define a concave cup 14 having a aperature at its base above and within a circular recess 15.

In use, the panels 10 are arranged over the pedestals 11 so that the four panel corners at each cruciform joint overlie the flange 24 of a pedestal head 23 with the concave cup defined by the panels located in the cup 26 in the boss 25 of the head 23 and with the boss 25 located within the recess 15.

Figure 3:
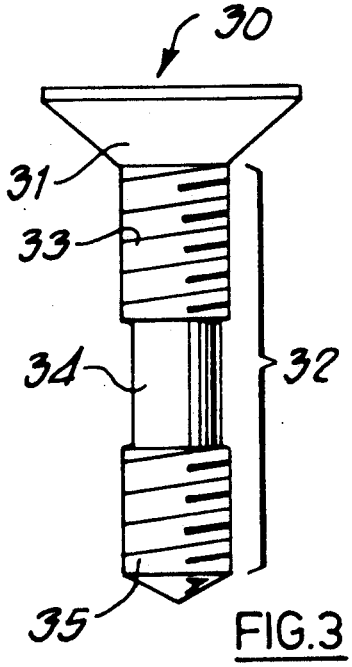
FIG. 3 shows a side view of the fastening means of FIG. 2 on a still further enlarged scale.

A screw fastener 30 (see FIG. 3) has a head 31 sized to fit within the cup 14 and a shank 32 having a first threaded portion 33 adjacent the head 31, an unthreaded waist portion and a terminal threaded portion 35 which is driven through the threaded bore 27 to hold the fastener captive to the pedestal head.

With the panels 10 in position on the pedestals, the fasteners may have their portions 33 engaged with the bores 27 and tightened to clamp the panels to the pedestals and form an integrated structure.

It will be appreciated that it is not intended to limit the invention to the above example only, many variations, such as might readily occur to one skilled in the art, being possible, without departing from the scope thereof.

Thus, for example, the panels need not be arranged in chequer-board fashion, but such that generally T-shaped joints between three adjacent panels are provided, there being a pedestal beneath each such joint and the panels being formed with quarter annular and half annular concavities to enable fastening as previously described.

I claim:

1. Access flooring, which comprises:

a plurality of support pedestals each including a floor substrate engaging base and an upper, floor panel receiving cup formation with a screw thread formed in said cup formation;

captive screw means engageable with said screw thread; and a plurality of floor panels having corners for engaging said cup formation so that four adjacent corners of said panels form a concave cup for engaging said cup formation of one of the pedestals and are engaged and retained by said captive screw means.

2. Access flooring according to claim 1, wherein said panel corners are countersunk and said captive screw means is correspondingly shaped so as to provide a level floor surface when engaged with said screw thread to retain said floor panels.

3. Access flooring according to claim 2, wherein said screw means comprises a conical screw head.

* * * * *